United States Patent [19]

Smillie

[11] Patent Number: 4,605,523

[45] Date of Patent: Aug. 12, 1986

[54] APPARATUS FOR IMPROVED FUEL EFFICIENCY

[76] Inventor: Winston B. Smillie, 2760 Park Ave., Laguna Beach, Calif. 92651

[21] Appl. No.: 616,995

[22] Filed: Jun. 4, 1984

[51] Int. Cl.[4] ..... F02M 27/04

[52] U.S. Cl. ..... 261/1; 261/145; 261/DIG. 80; 123/537

[58] Field of Search ..... 261/DIG. 80, 1, 145; 123/537

[56] References Cited

U.S. PATENT DOCUMENTS

| | | | |
|---|---|---|---|
| 1,771,626 | 7/1930 | Hamilton | 123/537 |
| 3,110,294 | 11/1963 | Nyman | 261/DIG. 80 |
| 3,805,492 | 4/1974 | King | 123/537 |
| 4,121,543 | 10/1978 | Hicks, Jr. et al. | 123/537 |
| 4,347,825 | 9/1982 | Suzuki et al. | 261/DIG. 80 |
| 4,460,516 | 7/1984 | Kapitanov et al. | 261/DIG. 80 |

*Primary Examiner*—Tim Miles

*Attorney, Agent, or Firm*—Townsend and Townsend

[57] ABSTRACT

A novel device and method for use in treating a combustible fluid mixture prior to its entering the combustion zone of an engine, furnace or the like, involve imposing electric and magnetic fields through the flow path of the fluid, perpendicular to the direction of flow as well as to each other. The ionizing effect of the electric field when combined with the magnetic field produces an effect akin to the Hall effect, with a substantial increase in the combustibility of the fuel mixture. The invention is particularly useful in improving the fuel economy of a petroleum-based fuel engine.

2 Claims, 2 Drawing Figures

APPARATUS FOR IMPROVED FUEL EFFICIENCY

BACKGROUND OF THE INVENTION

The present invention relates to the combustion of fluid fuels, and particularly to the treatment of a combustible fluid mixture prior to its entry into a combustion zone with the effect of enhancing the combustibility of the mixture.

In the typical system for feeding fuel to an internal combustion engine, a liquid hydrocarbon fuel is finely atomized in a stream of air, resulting in a combustible mixture consisting of a dispersion of fine fuel droplets. Even when the dispersion is preheated prior to its entry into the combustion zone, the fuel is not completely vaporized and it remains primarily in the form of droplets. Since only those molecules at the surface of the fuel droplets are in contact with air, incomplete combustion occurs in the short time in which the mist is in the combustion zone. The result is a failure to use the full capacity of the fuel and a discharge of unoxidized or partially oxidized species into the atmosphere as undesirable pollutants. Thus, for both environmental and economic concerns, any increase in fuel efficiency in internal combustion engines or combustion zones in general is a goal worth striving for.

SUMMARY OF THE INVENTION

It has now been discovered that a substantial increase in fuel efficiency is obtained by subjecting a combustible mixture to a combination of electric and magnetic fields, each oriented perpendicular to the direction of flow and to each other, prior to the entry of the mixture into the combustion zone. The technique is generally applicable to combustible fluid compositions in general, but is primarily of interest as applied to gaseous compositions or mists. Fuels on which the present invention can be applied to beneficial effect include vaporizable fuels in general, although petroleum-based fuels, such as oil, natural gas, propane, gasoline, and the like are of particular interest. The invention has broad-based utility, notably in connection with vehicle engines, appliances for both home and industrial use, power generators, heating and cooling systems, etc. The invention is of particular utility when applied to petroleum-based fuels in internal combustion engines, where it has a catalytic effect apparently through molecular reformation.

DESCRIPTION OF THE SPECIFIC AND PREFERRED EMBODIMENTS

Figure 1:
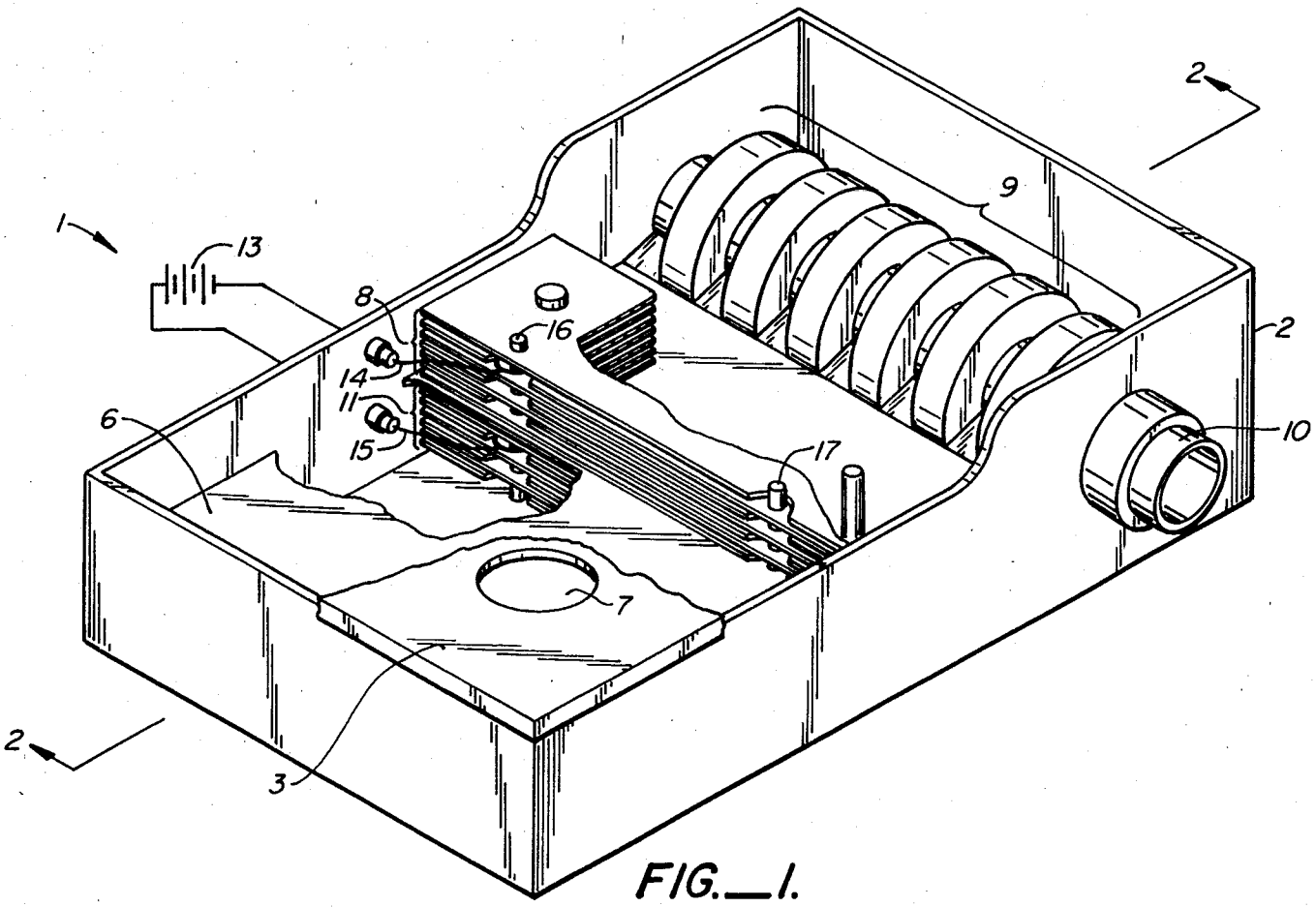
FIG. 1 is a partial cutaway view in perspective of an illustrative embodiment of a device according to the present invention.

It is contemplated that one of the most useful applications of the present invention will be in connection with an internal combustion engine. In such an engine, the device and method of the present invention will be employed between the carburetor and the combustion zone. In this and all other embodiments, it is contemplated that the entire combustion mixture, including both fuel and oxygen, will have been formed in a substantially uniform manner, notably a fine mist, prior to entering the region in which the present effect takes place.

As stated above, the unusual effects achieved by the present invention are attributed to the sequential arrangement of magnetic and electric fields along the flow path of the fuel mixture. The number and sequence of such fields is not critical, and can vary widely. A particularly convenient arrangement, in terms of space and operation, is that shown in the figures, wherein the flowing mixture is initially subjected to a first electric field, then a magnetic field, and finally a second electric field, with each field consisting of a series of narrow parallel adjacent fields of equal intensity but alternating direction, established by closely spaced plates of alternating electric charge or magnetic pole.

As shown in the figures, the overall device is designated by the numeral 1, and comprises an enclosed chamber 2 with a lid 3. The chamber is divided into two compartments, an upper compartment 4 and a lower compartment 5 by a separating plate 6. The fuel mixture from the carburetor enters the upper compartment 4 at one end through an intake port 7 in the lid. The mixture then flows through the first electrified stack 8 which consists of several thin flat parallel plates separated by nonconductive spacers. The mixture then flows to the other end of the chamber along the direction indicated by the upper arrow in FIG. 2, and passes through the spaces between an array of parallel magnetic disks 9. The disks are oriented such that the magnetic field imposed on the fluid mixture is directed at an angle approximately 90° with respect to the electric field imposed by the first electrified stack 8. The disks are magnets of alternating pole, setting up a lateral series of magnetic fields of equal intensity but each adjacent pair being in opposite directions. The disks are supported by a central shaft 10 and separated by nonmagnetic spacers (not shown). The plate 6 dividing the upper and lower chambers extends into the spaces between the magnetic disks and terminates at the central shaft. As the fuel mixture flows around the shaft it thus passes from the upper chamber to the lower chamber, then flows back through the lower chamber in the direction indicated by the lower arrow in FIG. 2, through a second electrified stack 11, identical and parallel to the first. After passing through the second electrified stack, the fuel mixture continues back toward the entry end of the chamber through the lower compartment and out through the exit port 12 to the engine intake manifold.

The two electrified stacks are connected to a common direct current power source 13 which supplies a constant voltage between each pair of plates in the stacks. This is accomplished through a pair of electric leads 14 and 15 and a pair of conductive pins 16 and 17, each pin passing through the entire double stack and electrically connected to every other plate, one pin connected to the even-numbered plates and the other to the odd-numbered. Both pins are insulated from the separation plate 6.

The size, number and spacing of the plates is not critical, but may vary widely depending on the size of the device and the flow rate of the fuel mixture. In a typical medium-size automobile, plate stacks containing from about seven to about fourteen plates each will be convenient from a construction viewpoint as well as effectiveness of operation. As for the dimensions, for most applications a plate thickness and inter-plate spacing ranging from about 1/32-inch (0.08 cm) to about 1/16-inch (0.16 cm) will provide the best results.

The application of a voltage between the plates results in partial ionization of the fuel mixture. The combination of this partial ionization in the perpendicularly directed magnetic field produces an effect similar to the Hall effect. With this in mind, the voltage and flow velocity may vary widely, depending upon considerations of degree of vacuum pulled, spacing between the plates, and the acceleration results sought. For most applications, a voltage differential ranging from about 0.5 to about 16 volts will provide the best results.

The plates may be constructed of any electrically conductive material, and any of the wide range of materials known to have this property will be useful. Preferred materials are those which are noncorrosive. Particularly preferred, however, are materials which are catalytic to hydrocracking. These include a large number of metals, metallic compounds and alloys. Examples are molybdenum, cadmium, platinum, silver, aluminum, bronze, alumina, silica, titanium, chromium, cobalt, copper, nickel, calcium zirconate, magnesium zirconate, molybdenum trioxide, and the like, plus alloys and mixtures thereof. Stacks consisting of alternating plates of different metals have been found to be particularly effective.

The magnetic plates may similarly vary in size, number, configuration, etc., provided that the magnetic field is perpendicular to both the direction of flow and the direction of the ionizing current in the electrified stacks. The plates may be constructed of any common ferromagnetic material arranged in alternating poles so that a unidirectional, substantially uniform magnetic field exists. In most applications, an array consisting of from about three to about twenty plates, with a spacing ranging from about ⅛-inch (0.32 cm) to about ¼-inch (0.64 cm) will provide the best results. The field strength may also vary widely. In most applications, however, a field strength ranging from about $1.0\times10^3$ to about $100\times10^3$ gauss will provide the best results.

In preferred embodiments, the magnetic plates also serve as heating fins and the central shaft 10 serves as a heat-conducting conduit containing engine exhaust heat exchange. As the hot exhaust gases pass through the central shaft, they supply heat through the plates to the fuel mixture passing between the plates.

In further preferred embodiments, the device is operated with the fuel mixture at subatmospheric pressure, the degree of vacuum preferably ranging from about 15 to about 25 inches of mercury (0.16 to about 0.84 atmosphere). In further preferred embodiments, water vapor is included in the fuel mixture for overall enhancement of effectiveness.

The following example is offered for illustrative purposes only, and is intended neither to illustrate nor define the invention in any manner.

EXAMPLE

Figure 2:
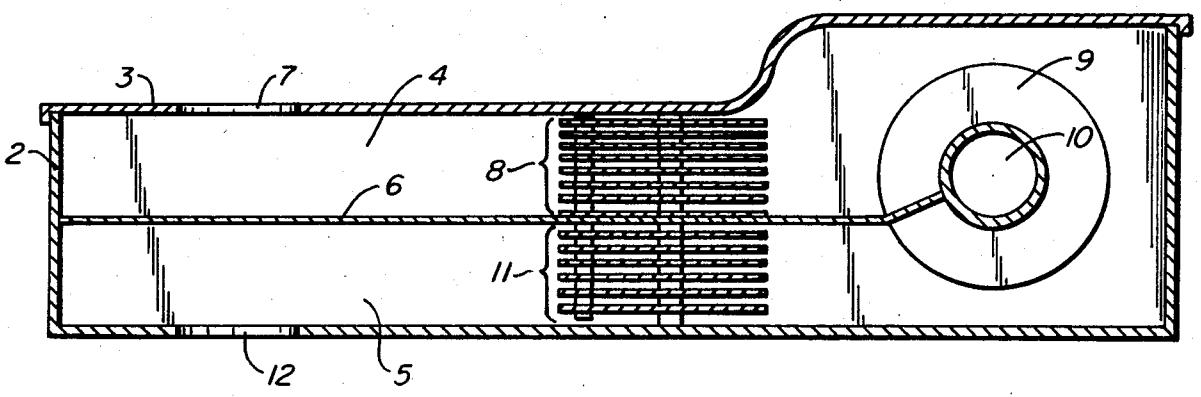
FIG. 2 is a cross-sectional view of the device of FIG. 1.

A device having the construction shown in FIGS. 1 and 2 was tested in a 1969 Cadillac Coupe de Ville equipped with a 472 cubic inch (7700 cubic centimeter) displacement standard engine. The device was installed between the carburetor and the intake manifold, and was constructed as follows: the two ionization stacks consisted of seven plates each, each plate measuring 2 by 6 inches (5 by 15 cm) and 1/32 inch (0.08 cm) in thickness, with a spacing between the plates of 1/16 inch (0.16 cm), using different metals from one plate to the next, including alumina/silica, chromium, cobalt-/molybdenum, copper/nickel, silver/titanium, tungsten carbide, magnesium zirconate, nickel-coated graphite, aluminum-bronze, calcium zirconate, molybdenum trioxide, low-carbon iron, silver, and titanium; the voltage across the two electric terminals was 1.5 volts, supplied by a battery; the magnetic plate array consisted of eleven disks, each measuring 3.125 inch (7.9 cm) in diameter and 0.44 inch (1.11 cm) in thickness, with a separation of 0.104 inch (0.26 cm), having a total magnetic flux of approximately 10,000 gauss.

The foregoing description is intended for illustrative purposes only. Numerous modifications and variations from the details described above which still fall within the spirit and scope of the invention will be readily apparent to those skilled in the art.

What is claimed is:

1. A device for enhancing the combustibility of a combustible fluid mixture which comprises:

an enclosed chamber having an inlet port, an outlet port and a channel for the continuous flow of said fluid mixture therebetween;

a plurality of regularly spaced parallel plate electrodes of alternating charge establishing an electric field across two portions of said channel in a direction perpendicular to the direction of flow of said fluid mixture; and a plurality of regularly spaced parallel plates of ferromagnetic material of alternating polarity establishing a magnetic field across one portion of said channel between said electric field portions in a direction perpendicular to both the direction of flow of said fluid mixture and the direction of said electric fields.

2. A device for enhancing the combustibility of a combustible fluid mixture which comprises:

an enclosed chamber having an inlet port, an outlet port and a channel for the continuous flow of said fluid mixture therebetween;

means for establishing an electric field across two portions of said channel in a direction perpendicular to the direction of flow of said fluid mixture;

a plurality of parallel ferromagnetic plates establishing a magnetic field across one portion of said channel between said electric field portions in a direction perpendicular to both the direction of flow of said fluid mixture and the direction of said electric fields; and a hollow conduit passing through the center of said ferromagnetic plates and perpendicular thereto, to receive a heat exchange fluid for transmission of heat therefrom through said ferromagnetic plates to said combustible fluid mixture.

* * * * *